US010954967B2

(12) United States Patent
Dong

(10) Patent No.: US 10,954,967 B2
(45) Date of Patent: Mar. 23, 2021

(54) HYDRAULIC MACHINE

(71) Applicants: NINGBO DEMA INTELLIGENT MACHINERY CO., LTD., Ningbo (CN); Xiangyi Dong, Ningbo (CN)

(72) Inventor: Xiangyi Dong, Ningbo (CN)

(73) Assignee: NINGBO DEMA INTELLIGENT MACHINERY CO., LTD., Ningbo (CN)

( * ) Notice: Subject to any disclaimer, the term of this patent is extended or adjusted under 35 U.S.C. 154(b) by 93 days.

(21) Appl. No.: 16/517,545

(22) Filed: Jul. 20, 2019

(65) Prior Publication Data

US 2019/0338791 A1 Nov. 7, 2019

Related U.S. Application Data

(63) Continuation of application No. PCT/CN2018/096141, filed on Jul. 18, 2018.

(30) Foreign Application Priority Data

Jul. 18, 2017 (CN) ..... 201710585256.7
Jul. 18, 2017 (CN) ..... 201710585444.X
(Continued)

(51) Int. Cl.
*F15B 7/08* (2006.01)
*F15B 15/14* (2006.01)
*F15B 7/00* (2006.01)

(52) U.S. Cl.
CPC ..... *F15B 7/003* (2013.01); *F15B 7/08* (2013.01); *F15B 15/1409* (2013.01)

(58) Field of Classification Search
CPC ..... F15B 7/003; F15B 7/08; F15B 15/1409; B30B 1/32; B30B 7/04; B30B 7/02
See application file for complete search history.

(56) References Cited

U.S. PATENT DOCUMENTS 5,145,353 A * 9/1992 Zakich ..... B29C 45/12 425/588
9,541,100 B2 1/2017 Shi et al.

FOREIGN PATENT DOCUMENTS

CN 2671876 Y 1/2005
CN 204975954 U 1/2016
(Continued)

OTHER PUBLICATIONS

International Search Report of PCT/CN2018/096141.

*Primary Examiner* — F Daniel Lopez
*Assistant Examiner* — Daniel S Collins

(57) ABSTRACT

The present disclosure discloses a hydraulic machine including a support assembly and a main cylinder device connected with the support assembly. The main cylinder device includes at least two main cylinder assemblies and at least two piston rods respectively. The at least two piston rods are opposite to each other and move along opposite directions and on the same straight line. A support worktable device is disposed on the support assembly and spaced with the main cylinder device. At least two pressing mechanisms are formed between the support worktable device and the at least two main cylinder assemblies or between the support worktable device and the at least two piston rods. The at least two pressing mechanisms are configured for pressing work pieces simultaneously.

15 Claims, 15 Drawing Sheets

(30) Foreign Application Priority Data

| | | |
|---|---|---|
| Jul. 18, 2017 | (CN) | 201710585461.3 |
| Jul. 18, 2017 | (CN) | 201710585825.8 |
| Jul. 18, 2017 | (CN) | 201720870803.1 |
| Jul. 18, 2017 | (CN) | 201720871380.5 |
| Jul. 18, 2017 | (CN) | 201720871387.7 |
| Jul. 18, 2017 | (CN) | 201720871870.5 |
| Jul. 19, 2017 | (CN) | 201710591502.X |
| Jul. 19, 2017 | (CN) | 201720877317.2 |
| Sep. 1, 2017 | (CN) | 201710796069.3 |
| Sep. 1, 2017 | (CN) | 201721110914.9 |
| Sep. 4, 2017 | (CN) | 201710787346.4 |
| Sep. 4, 2017 | (CN) | 201721124707.9 |
| Dec. 3, 2017 | (CN) | 201711255999.4 |
| Dec. 3, 2017 | (CN) | 201721657019.9 |

(56) References Cited

FOREIGN PATENT DOCUMENTS

| | | | |
|---|---|---|---|
| CN | 106286462 | A | 1/2017 |
| WO | WO2013040872 | A | 3/2013 |

* cited by examiner

HYDRAULIC MACHINE

CROSS-REFERENCE TO RELATED APPLICATIONS

This application is a continuation of PCT patent application PCT/CN2018/096141 filed on Jul. 18, 2018, which claims all benefits accruing under 35 U.S.C. § 119 from China Patent Application Nos. 201710585256.7, filed on Jul. 18, 2017, 201710585444.X, filed on Jul. 18, 2017, 201710585461.3, filed on Jul. 18, 2017, 201710585825.8, filed on Jul. 18, 2017, 201710591502.X, filed on Jul. 19, 2017, 201710787346.4, filed on Sep. 4, 2017, 201710796069.3, filed on Sep. 1, 2017, 201711255999.4, filed on Dec. 3, 2017, 201720870803.1, filed on Jul. 18, 2017, 201720871380.5, filed on Jul. 18, 2017, 201720871387.7, filed on Jul. 18, 2017, 201720871870.5, filed on Jul. 18, 2017, 201720877317.2, filed on Jul. 19, 2017, 201721110914.9, filed on Sep. 1, 2017, 201721124707.9, filed on Sep. 4, 2017, 201721657019.9, filed on Dec. 3, 2017, in the State Intellectual Property Office of China, the content of which is hereby incorporated by reference.

TECHNICAL FIELD

The present disclosure relates to the field of hydraulic press technology, and in particular, to a hydraulic machine thereof.

BACKGROUND

With the development of automotive industry, the demand for the number and the performance of automobile hubs are increasing. Automobile hubs can be generally made by hydraulic equipment. However, the hydraulic equipment in the art is typically heavy, expensive, complicated in manufacturing and low in production efficiency.

SUMMARY

Various embodiments in the present disclosure of a hydraulic machine includes a support assembly and a main cylinder device connected with the support assembly, wherein the main cylinder device comprising at least two main cylinder assemblies and at least two piston rods respectively connected with the at least two main cylinder assemblies, a hydraulic chamber is formed between each of the at least two piston rods and each of the at least two main cylinder assemblies, the at least two piston rods are arranged opposite to each other and move along a same straight line and in opposite directions. The hydraulic machine can also include a support worktable device disposed on the support assembly and spaced with the main cylinder device, and at least two pressing mechanisms formed between the support worktable device and the at least two main cylinder assemblies or between the support worktable device and the at least two piston rods, wherein the at least two pressing mechanisms are configured for pressing work pieces simultaneously.

Details of one or more embodiments of the present disclosure are set forth in the drawings and accompanying descriptions below. Other features, objects, and advantages of the present disclosure will be apparent from the descriptions, drawings and claims. At the same time, the embodiment section describes the expressions corresponding to the original technical effects and advantages.

BRIEF DESCRIPTION OF THE DRAWINGS

For better description and illustration of embodiments and/or examples of the present disclosure, one or more drawings can be provided. Additional details or examples for describing the drawings should not be considered as limiting the scope of any of the present disclosure, the presently described embodiments and/or examples, and the best mode.

DETAILED DESCRIPTION

The present disclosure will be further described in detail below with reference to the drawings and specific embodiments, in order to better understand the embodiments of the present disclosure. It is obvious that the described embodiments are only a part of the embodiments of the present disclosure, and not all of the possible embodiments. Based on the embodiments in the present disclosure, all other embodiments obtained by one skilled in the art without creative efforts are within the scope of the present disclosure.

It should be noted that when a component is referred to as being "mounted on" another component, it can be directly disposed on another component or a third component can also be disposed between the two. When a component is considered to be "set to" another component, it can be placed directly on another component or a third component can also be disposed between the two. When a component is considered to be "fixed" to another component, it can be directly attached to another component or a third component can also be disposed between the two.

All technical and scientific terms used herein have the same meaning as commonly understood by one in the art to which the present disclosure belongs, unless they are specifically defined. The terminology used herein is for the purpose of describing the embodiments and not intended to be limiting. The term "or/and" as used herein includes any one and all combinations of the associated listed items.

Figure 1:
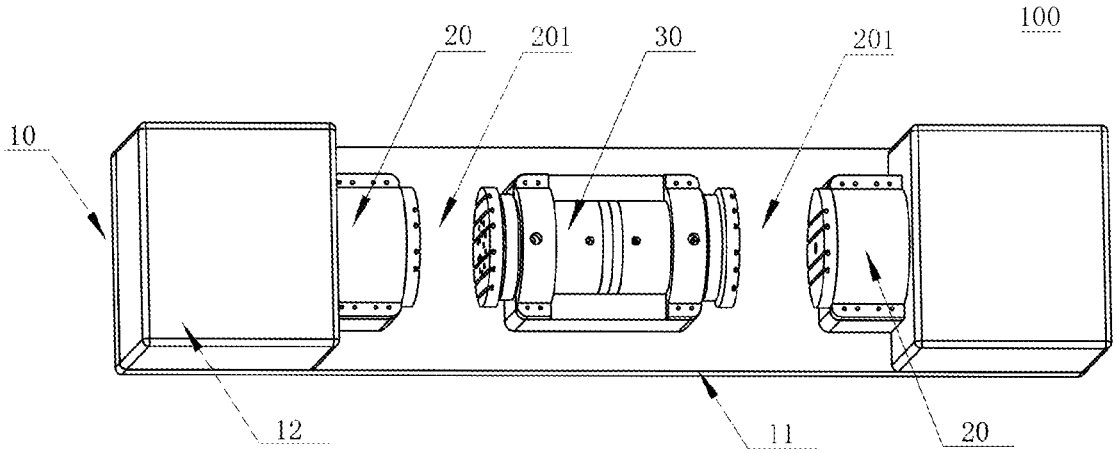
FIG. 1 is a perspective view of a hydraulic machine in an embodiment of the present disclosure.

Referring to FIG. 1, the present disclosure provides a hydraulic machine 100 configured for forming a wheel hub of an automobile. The hydraulic machine 100 can include a support assembly 10, a support worktable device 20, and a main cylinder device 30. The support worktable device 20 and the main cylinder device 30 can be disposed on the support assembly 10. The main cylinder device 30 can be slidably or rollably connected with the support assembly 10.

The material of the support assembly 10 may be one of reinforced concrete, pure steel, or casting and forging. The support assembly 10 includes a pedestal 11 and at least two support tables 12. The at least two support tables 12 are respectively disposed on two ends of the pedestal 11, result in forming a concave shape or "U" shape structure with the pedestal 11. The support worktable device 20 and the main cylinder device 30 can be arranged within the concave shape or "U" shape structure. In a preferred embodiment, the pedestal 11 and the at least two support tables 12 can form an integrity structure to improve the structural strength of the support assembly 10 and its stability during operation.

Figure 2:
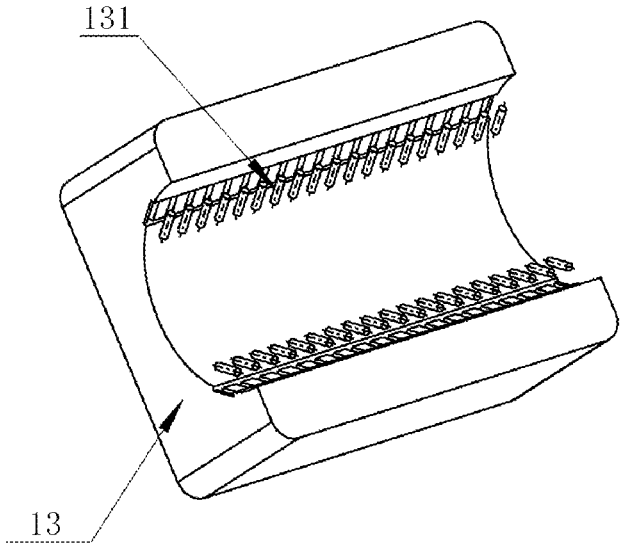
FIG. 2 is a perspective view of a mounting seat in another embodiment of the present disclosure.

Referring to FIG. 2, the support assembly 10 further includes a mounting seat 13 disposed on the pedestal 11 and configured for mounting the main cylinder device 30. Furthermore, the mounting seat 13 can be provided with a plurality of sliding rails 131 for realizing a sliding or rolling connection between the main cylinder device 30 and the support assembly 10. In this embodiment, the sliding rail 131 may be formed by a plurality of sticks parallel to each other. Preferably, the number of the plurality of slide rails 4 are four.

Figure 3:
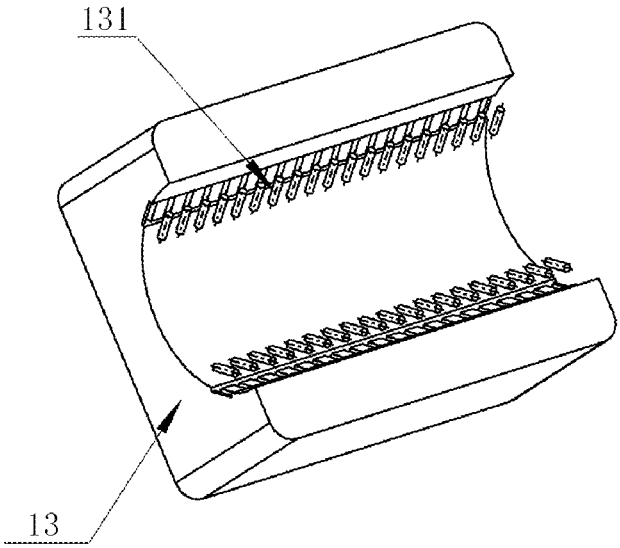
FIG. 3 is a perspective view of a hydraulic machine including a support assembly in another embodiment of the present disclosure.
Figure 4:
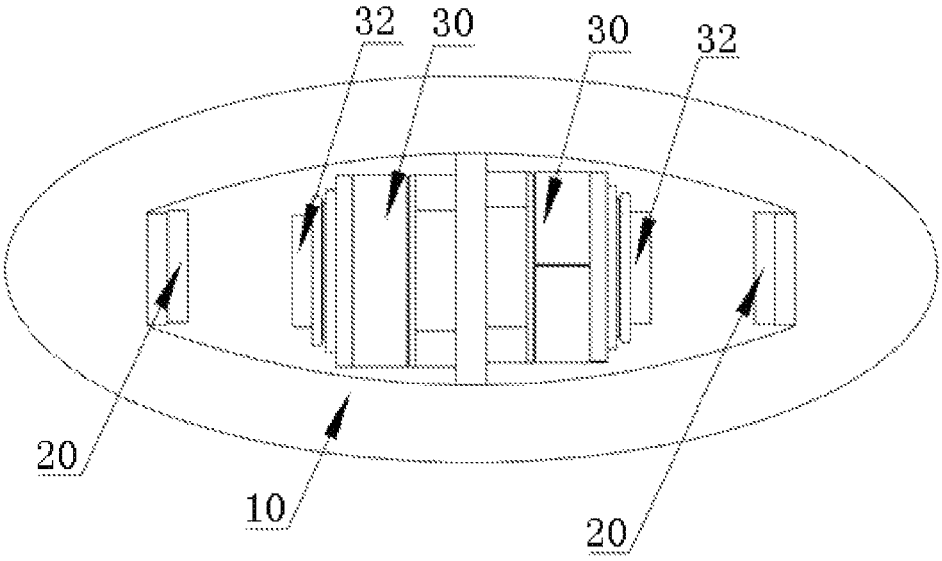
FIG. 4 is a side view of the hydraulic machine of FIG. 3.
Figure 5:
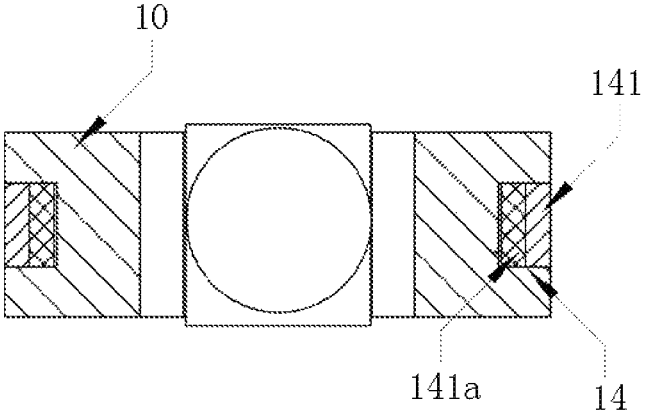
FIG. 5 is a cross-sectional view of the hydraulic machine of FIG. 3.

In another embodiment, as shown in FIG. 3 to FIG. 5, the support assembly 10 can be a closed annular or ring-like structure. The support worktable device 20 and the main cylinder device 30 can be fixed on an inner wall of the support assembly 10. It should be understood that the support assembly 10 can be the closed annular or ring-like structure, that is, the support assembly 10 can have an outer ring and an inner ring structure, the support assembly 10 has a certain thickness, and the inner ring is hollow. It should be noted that the annular or ring-like structure includes a long axis and a short axis, and the support worktable device 20 and the main cylinder device 30 can be disposed along the long axis direction of the support assembly 10. Preferably, in this embodiment, the outer ring of the support assembly 10 can have an elliptical shape, the inner ring can have an approximately rectangular shape, and corners of the inner ring of the support assembly 10 can be rounded, so that the inner ring can include a rectangular space.

Preferably, a cross section of the support assembly 10 in the short axis direction is an olive-like or elliptic shape, the support worktable device 20 can be fixed at ends along the long axis, and the main cylinder device 30 is disposed at a middle of the support assembly along the long axis. It should be noted that the olive-like or elliptic shape described herein has a thickness, and the outer shape of the support assembly 10 can be in an olive-shaped slice structure, which is simply referred to as an olive-shaped support assembly 10. The olive-shaped support assembly 10 can provide pre-stressed curved support and has stronger structural stability. At the same time, the inner ring can compress equipment space to an extreme, result in reducing the space, weight and material cost of the hydraulic machine when the equipment requirements are met.

In order to improve mechanical properties of the support assembly 10 and ensure its structural stability, an outer wall of the support assembly 10 is provided with a steel wire 14 around the olive-like or elliptic shape. Preferably, the steel wire 14 is reciprocally wound around the olive-shaped support assembly 10 along the long axis, i.e., from one end of the long axis of the olive-like or elliptic shape to the other end. The olive-shaped support assembly 10 can provide greater friction and adhesion to the steel wire 14, and is not easy to fall off and loosen, so that the winding performance is stronger, and the structural instability is effectively suppressed. The continuous arc-shape of the outer wall of the olive-shaped support assembly 10 can provide sufficient strength. The outer wall of the olive-shaped support assembly 10 is wound by the steel wire 14, so the overall structure is more evenly stressed, thereby providing higher strength to the overall hydraulic machine, thereby ensuring long-term stable operation of the hydraulic machine 100.

Preferably, the outer wall of the support assembly 10 is provided with a groove 141 configured for accommodating the steel wire 14 when winding the steel wire 14. Part of the steel wire 14 can be located in the groove 141. Preferably, the groove 141 can be padded with a plurality of broken iron blocks 141*a* for increasing friction between the steel wire 14 and the outer wall of the support assembly 10 and preventing the steel wire 14 from rotating or sliding.

In this embodiment, the support assembly 10 is the olive-like support assembly, and the continuous smooth curved surface of the outer wall can make the overall structure uniformly pressed, result in enhancing the support strength, optimizing the space, reducing the weight of the support assembly 10, and saving materials. The outer wall is wound by the steel wire 14 which can further stabilize the structure. At the same time, due to the olive-like structure, the space for winding the steel wire 14 is relatively reduced, and the frictional force of the steel wire 14 winding is correspondingly enhanced, which can effectively suppress structural instability, enhance the overall mechanical properties, improve the structural rigidity and long-term stability of the hydraulic machine 100, reduce the use of materials and production costs, and save resources.

Figure 6:
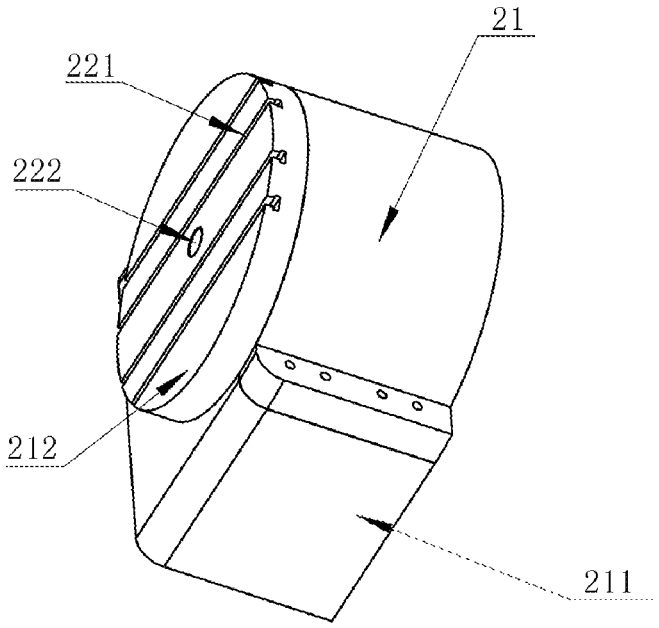
FIG. 6 is a perspective view of a single-sided support worktable assembly in another embodiment of the present disclosure.

Referring to FIG. 6, the support table device 20 can include a plurality of single-sided support worktable assemblies 21 and a movable worktable 22. The movable worktable 22 can be disposed on the main cylinder device 30. A pressing mechanism 201 can be formed by the movable worktable 22 and the single-sided support worktable assembly 21, that is, a pressing space is formed for accommodating a work piece, so that the main cylinder device 30 can be configured for driving the movable worktable 22 for pressing.

Further, the number of the plurality of single-sided support worktable assemblies 21 is two, and the two single-sided support table assemblies 21 are disposed opposite to each other and respectively mounted on the two support tables 12. The pressing mechanisms 201 can be respectively formed by the two single-sided support worktable assemblies 21 and the main cylinder devices 30. It should be noted that the two single-sided support worktable assemblies 21 are made of the same material in the same process to ensure that the two single-sided support worktable assemblies 21 can bear the same pressure.

In another embodiment, the two single-sided support worktable assemblies 21 can be mounted at both ends along the long axis of the olive-shaped support assembly 10, and the main cylinder device 30 can be disposed on the middle of the olive-shaped support assembly 10 along the long axis of the support assembly 10, and the press mechanisms 201 can be respectively formed by the main cylinder device 30 and the single-sided support worktable assemblies 21.

In detail, the single-sided support worktable assembly 21 can include a base 211 and a fixed worktable 212 configured for supporting the work piece. The base 211 can be disposed at a side of the support table 12, and the fixed worktable 212 can be fixed on the base 211. The pressing mechanism 201 can be formed by the movable worktable 22 and the fixed worktable 212.

Further, a plurality of worktables (not shown) are disposed between the fixed worktable 212 and the main cylinder device 30. At least one of the plurality of worktables is slidably disposed on the support assembly 10. The direction of movement of the plurality of worktables is the same as pressing direction of the main cylinder device 30 towards the work piece. A pressing mechanism 201 can be formed by the plurality of worktables and the fixed worktable 212, in order to obtain at least two work pieces simultaneously.

Preferably, the structure of the plurality of worktables can be the same as that of the fixed worktable 212.

The movable worktable 22 is substantially circular, and the movable worktable is provided with a T-type slot 221 configured for fixing a mold. The movable worktable 22 further includes a plurality of center hole ejection devices 222, which are configured for ejecting the work piece. Preferably, the center hole ejection devices 222 are substantially disposed at the center of the movable worktable 22.

Figure 7:
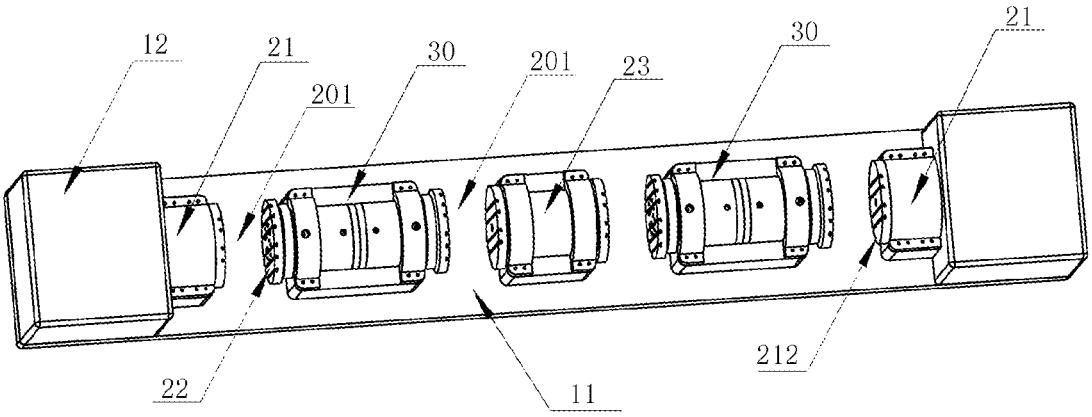
FIG. 7 is a perspective view of a hydraulic machine in another embodiment of the present disclosure.
Figure 8:
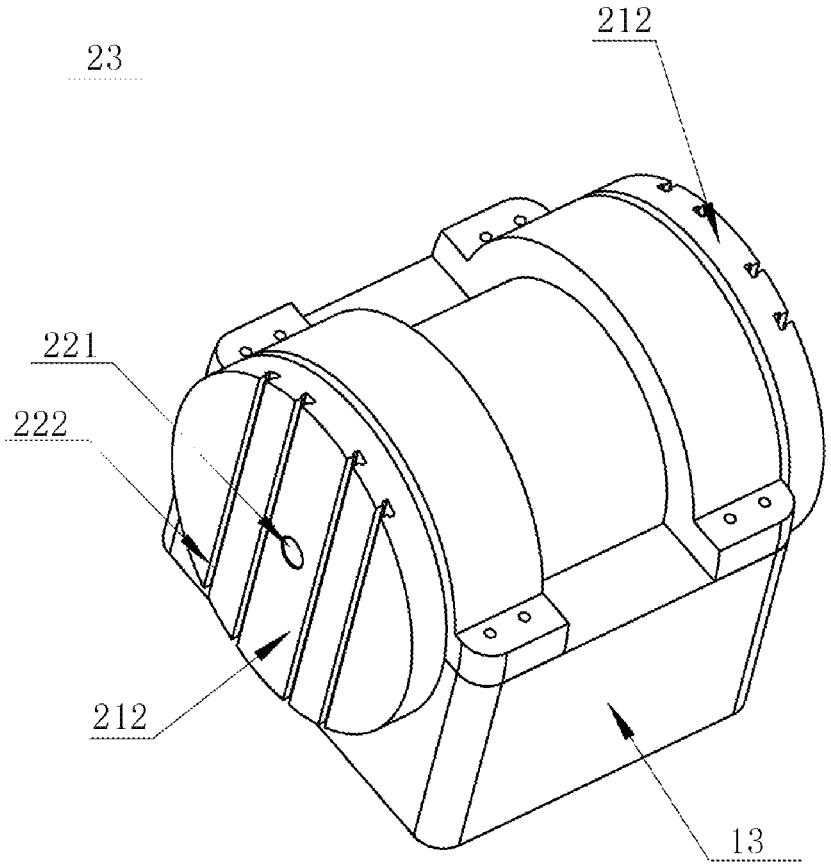
FIG. 8 is a perspective view of a double-sided support worktable assembly in another embodiment of the present disclosure.

In another embodiment, referring to FIGS. 7 and 8, the support worktable device 20 further includes a double-sided support worktable assembly 23 fixed to the substrate 11. The double-sided support worktable assembly 23 is disposed between two single-sided support worktable assemblies 21. And the main cylinder device 30 can be disposed between the double-sided support worktable assembly 23 and the single-sided support worktable assembly 21. A plurality of pressing mechanisms 201 are formed by the main cylinder device 30 and the single-sided support worktable assembly 21, and by the main cylinder device 30 and the double-sided support worktable assembly 23, respectively.

In this embodiment, the two single-sided support worktable assemblies 21, two main cylinder devices 30, and the double-sided support worktable assembly 23 are arranged in a line, resulting in forming four pressing mechanisms 201 for four work pieces.

The structure of the double-sided support worktable assembly 23 is substantially the same as that of the single-sided support worktable assembly 21, except that the double-sided support worktable assembly 23 includes two fixed worktables 212, which are mounted on the base 211 and opposite to each other to form a working platform capable of supporting the work piece on both sides. Preferably, the two fixed worktables 212 are coaxially arranged.

The fixed worktable 212 can be substantially circular. The fixed worktable 212 and the movable worktable 22 can be disposed opposite to each other. Another T-type slot 221 can be further disposed on the fixed worktable 212. At the same time, another center hole ejection device 222 can be substantially disposed at the center of the fixed worktable 212.

Further, the support worktable device 20 can be provided with an adsorption device (not shown) configured for fixing the work piece between the fixed worktable 212 and the movable worktable 22, so there is no need for manual fixing, which is convenient to operate and safe to produce.

Referring to FIG. 9 to FIG. 12, the main cylinder device 30 can play a role of a power output device for driving the movable worktable 22 to move toward the fixed worktable 212 to press the work piece.

In one embodiment, the main cylinder device 30 can be deposited on the pedestal 11 and located at middle of a line connecting the two single-sided support worktable assemblies 21. That is, the main cylinder device 30 can be at the middle, and the two single-sided support worktable assemblies 21 are located on sides of the main cylinder device 30.

In another embodiment, the main cylinder device 30 can include at least two main cylinder assemblies 31 and at least two piston rods 32 respectively connected with the at least two main cylinder assemblies 31. The at least two piston rods 32 are arranged opposite to each other and move along the same straight line and along opposite directions. At least two pressing mechanisms 201 are formed between the support worktable device 20 and the at least two main cylinder assemblies 31 or between the support worktable device 20 and the at least two piston rods 32, and the at least two pressing mechanisms 201 are configured for pressing work pieces simultaneously.

Figure 9:
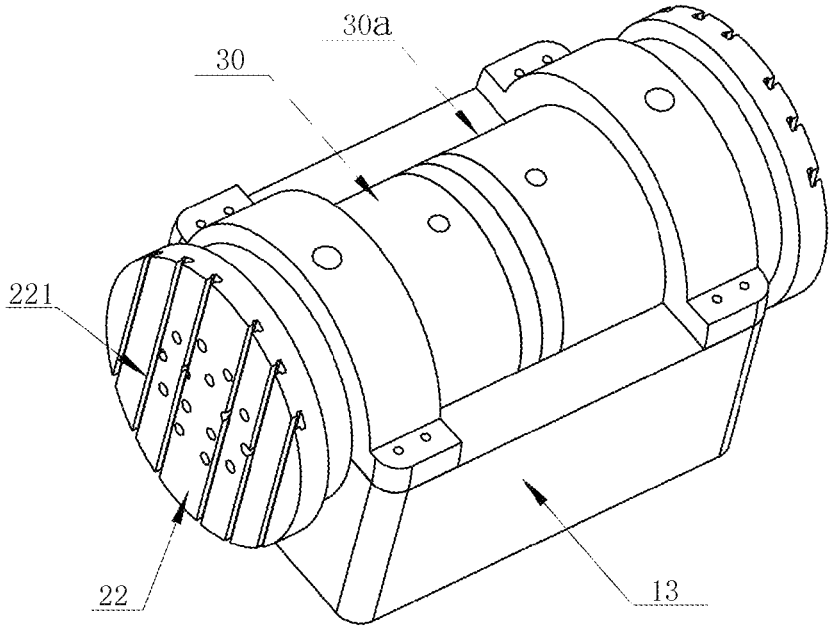
FIG. 9 is a perspective view of a main cylinder device in another embodiment of the present disclosure.
Figure 10:
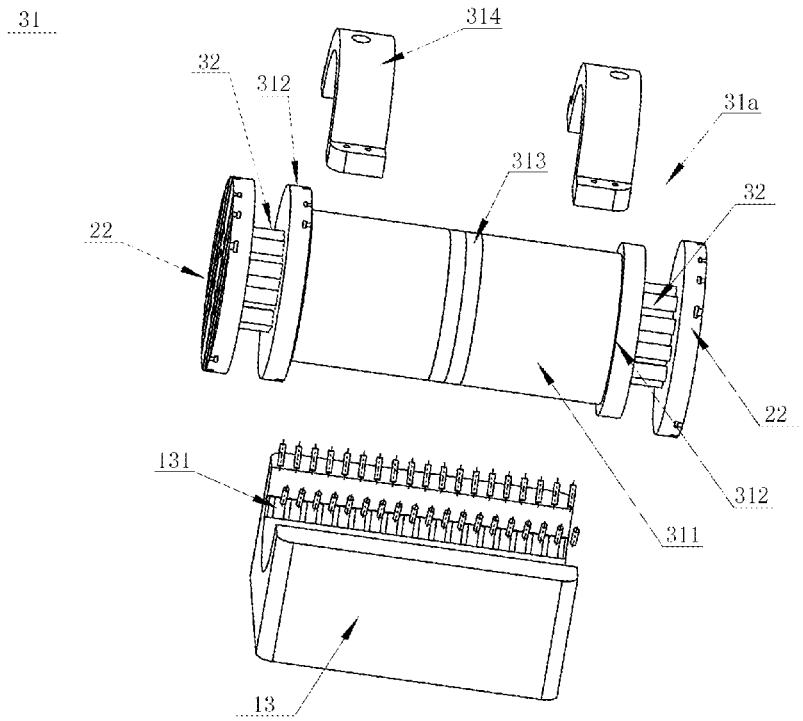
FIG. 10 is an exploded perspective view of a main cylinder device in another embodiment of the present disclosure.
Figure 11:
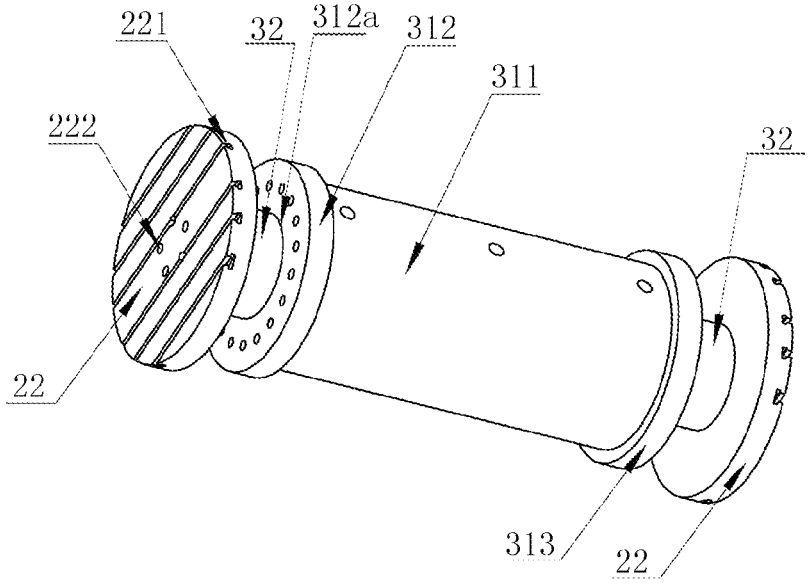
FIG. 11 is a perspective view of a main cylinder device in another embodiment of the present disclosure.
Figure 12:
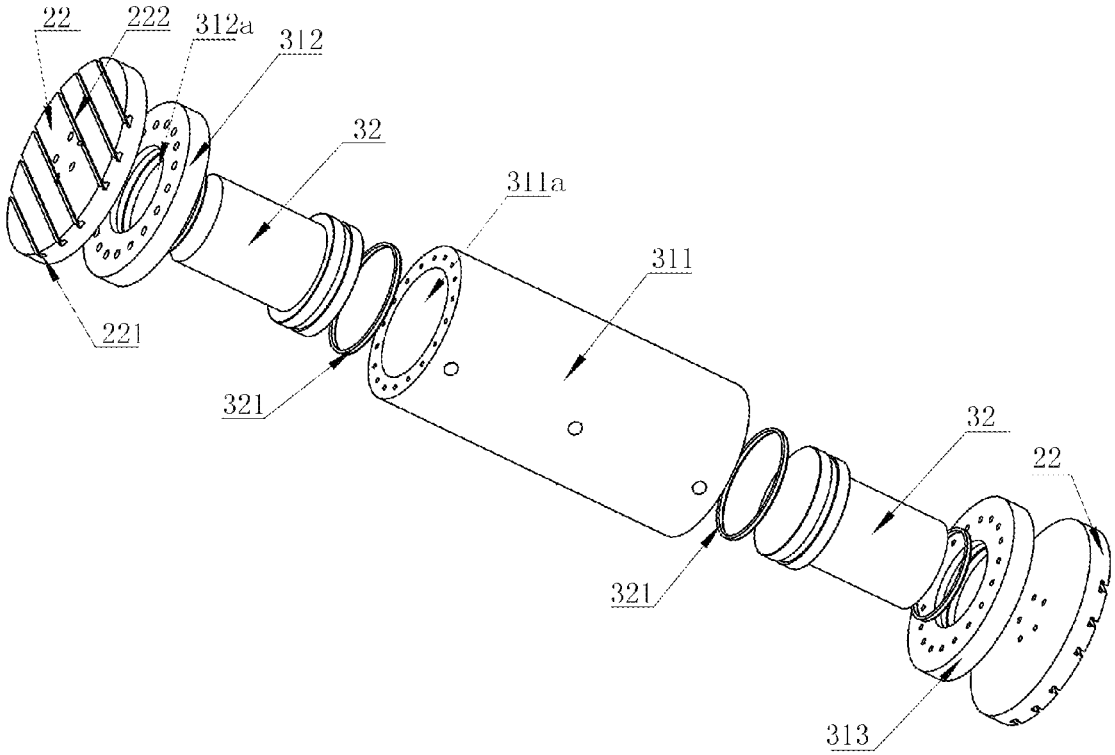
FIG. 12 is an exploded perspective view of a main cylinder device in another embodiment of the present disclosure.

Referring to FIG. 9, at least two actuating units **30*a* are formed by the at least two main cylinder assemblies 31 and the at least two piston rods 32. The support worktable device 20 is disposed between the at least two actuating units 30*a*. The at least two pressing mechanisms 201 are respectively formed between the support worktable device 20 and each of the at least two actuating units 30*a***.

In one embodiment, one of the piston rods 32 can be respectively corresponded to one of the main cylinder assemblies 31. That is, one of the piston rods 32 and one of the main cylinder assemblies 31 can form an actuating unit **30*a*. The actuating unit 30*a* can be disposed in the middle and the fixed worktables 212 are disposed on sides of the actuating unit 30*a*. Alternatively, the fixed worktables 212 can be disposed in the middle and the actuating units 30*a* are disposed on sides of the fixed worktables 212**.

Of course, in this embodiment, the movable worktable 22 can be disposed on the piston rod 32, or may be disposed on the main cylinder assembly 31. It is understood that when the movable worktable 22 is located on the piston rod 32, the piston rod 32 can move relative to the main cylinder assembly 31; when the movable worktable 22 is disposed on the main cylinder assembly 31, the main cylinder assembly 31 can move relative to the piston rod 32.

In another embodiment, at least two actuating units 30*a* can be formed by the at least two main cylinder assemblies 31 and the at least two piston rods 32 and disposed at the middle of the fixed table 212.

In this embodiment, the at least two main cylinder assemblies 31 are fixed and interconnected to form an integral cylinder unit. The at least two piston rods 32 respectively extend out from ends of the cylinder unit and are able to move relative to the cylinder unit, so the at least two piston rods 32 and the cylinder unit form the actuating units 30*a*.

It can be noted that the at least two main cylinder assemblies 31 can be fixed and interconnected to form the integral cylinder unit. The at least two piston rods 32 are opposite to each other and can move along the same straight line. That is, the cylinder unit can remain stationary, and the at least two piston rods 32 are movable. The hydraulic chamber can be formed between the at least two piston rods and the integral cylinder unit. When the main cylinder device is working, the hydraulic chamber has a spatial change, causing the at least two piston rods 32 to approach each other or move away from each other.

It will be understood that the piston rods 32 can also be provided in two sets. Two sets of the piston rods 32 respectively extend from both ends of the integral cylinder unit and can move relative to the integral cylinder unit. Each set of the piston rods 32 can include a plurality of piston rods.

Further, the main cylinder device 30 includes a main cylinder assembly 31 mounted on the mounting seat 13 and a plurality of piston rods 32 connected to the main cylinder assembly 31. The movable worktable 22 can be mounted on the plurality of piston rods 32. The number of the plurality of piston rods 32 is at least two or two sets. A hydraulic chamber (not shown) can be formed between the plurality of piston rods 32 and the main cylinder assembly 31. Two or two sets of the piston rods 32 can be mutually arranged in reverse direction and move in the same line. In operation, spatial variation of the hydraulic chamber will cause two or two sets of the piston rods 32 to move toward each other or away from each other.

Referring to FIG. 7, the at least two main cylinder assemblies 31 can be disposed in series.

Here, it should be explained that "two or two sets of the piston rods 32 are oppositely arranged" means that one ends of two or two sets of the piston rods 32 are disposed opposite to each other, and the other ends are opposite to each other. So, during operation, taking one ends of two or two sets of the piston rods 32 as an example, the one ends of two or two sets of the piston rods 32 are close to each other or move away from each other during the movement.

Embodiment 1

The main cylinder assembly 31 includes one main cylinder 31*a*. The main cylinder 31*a* is connected to two or two sets of piston rods 32 which are disposed opposite to each other. It should be understood that in this embodiment, two or two sets of the piston rods 32 which are disposed opposite to each other are connected to the main cylinder 31*a*, in order to form an integrity structure.

The main cylinder 31*a* includes a cylinder sleeve 311, a first cover 312, and a second cover 313. The cylinder sleeve 311 has two opposite ends, and the first cover 312 and the second cover 313 are respectively disposed at the two ends of the cylinder sleeve 311.

Preferably, the main cylinder 31*a* has a substantially cylindrical shape, the cylinder sleeve 311 has an axis. The cylinder sleeve 311 is provided with a first through hole 311*a* penetrating the cylinder sleeve 311 along the axis. One end of the piston rod 32 is disposed in the first through hole 311*a*, and the other end of the piston rod 32 penetrates and extends out from the first through hole 311*a*.

Further, the first cover 312 and the second cover 313 are disposed at two ends of the cylinder sleeve 311 and block the first through hole 311*a*. The first cover 312 and the second cover 313 have circular shapes and couple to the main cylinder 31*a*. The first cover 312 and/or the second cover 313 are provided with a second through hole 312*a*. One end of one of the two or two sets of piston rods 32 is disposed in the cylinder sleeve 311, and the other end of the one of the two or two sets of piston rods 32 protrudes from the first through hole 311*a* and the second through hole 312*a* of the first cover 312 and is connected to the movable worktable 22. One end of the other one of the two or two sets of piston rods 32 is disposed in the cylinder sleeve 312, and the other end of the other one of the two or two sets of piston rods 32 protrudes from the first through hole 311*a* and the second through hole 312*a* of the second cover 313 and is connected to the movable worktable 22.

Preferably, the main cylinder 31*a* further includes a fixing member 314 configured for coupling to the mounting seat 13 and fixing the main cylinder 31*a* on the mounting seat 13.

Of course, the number of the main cylinders 31*a* may be multiple, and each of the main cylinders 31*a* can be connected to the two or two sets of the piston rods 32, thereby pressing a plurality of work pieces simultaneously.

Embodiment 2

Embodiment 2 is basically the same as the structure and principle of embodiment 1, except that the main cylinder assembly 31 includes two opposite master cylinders 31*a* fixedly connected to form a joint structure. The two main cylinders 31*a* are coaxially disposed. One or of the two or two sets of piston rods 32 are connected to one of the two main cylinders 31*a*. The other of the two or two sets of the piston rods 32 is connected to the other of the two main cylinders 31*a*. In this embodiment, it should be understood that one or one set of piston rods 32 connected to the two main cylinders 31*a* together form two or two sets of piston rods 32, the two or two sets of piston rods 32 can move along the same line and with opposite direction.

In this embodiment, the first cover 312 is provided with the second through hole 312*a*. One end of one of the two or two sets of the piston rods is disposed in one of the two main cylinders 31*a*, and the other end of the one of the two or two sets of the piston rods penetrates through the second through hole 312*a* of the first cover 312 and is connected to the movable worktable 22.

In this embodiment, the number of the main cylinders 31*a* can be even, and each two of the main cylinders 31*a* can constitute one set of main cylinders, and each of the master cylinders 31*a* can be connected with one or one set of the piston rods 32.

The piston rods 32 include at least two or two sets. Two or two sets of the piston rods 32 are arranged opposite to each other and move along the same straight line. A hydraulic chamber (not shown) is formed between the piston rods 32 and the inner walls of the first through holes 311*a* in the main cylinder 31*a*. In operation, the space of the hydraulic chamber changes such that two or two sets of the piston rods 32 can be driven to move close to each other or away from each other, in order to drive the movable worktable 22 to move close to or away from the fixed worktable 212, thereby achieving to press the work piece.

The piston rod 32 is provided with a sealing member 321 configured for tight connecting the piston rods 32 with the inner wall of the first through hole 311*a*. In this embodiment, the sealing member 321 can be a rubber sealing ring.

Figure 13:
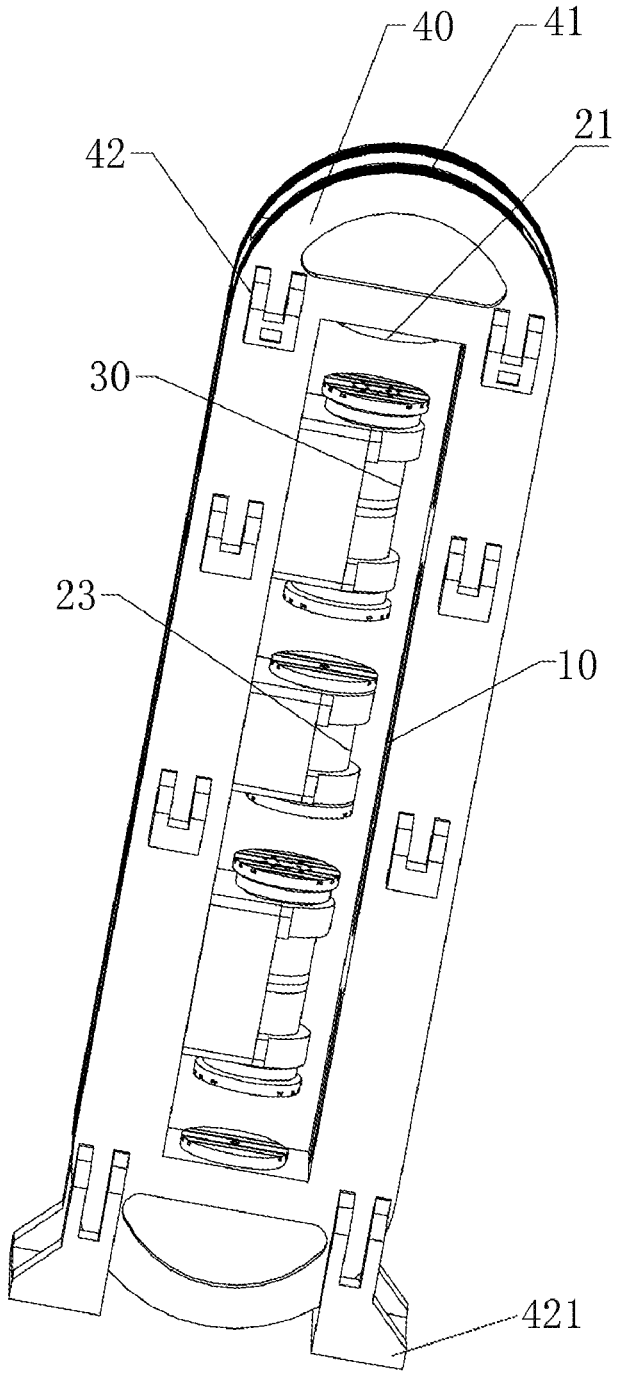
FIG. 13 is a perspective view of a vertical type hydraulic machine in another embodiment of the present disclosure.
Figure 14:
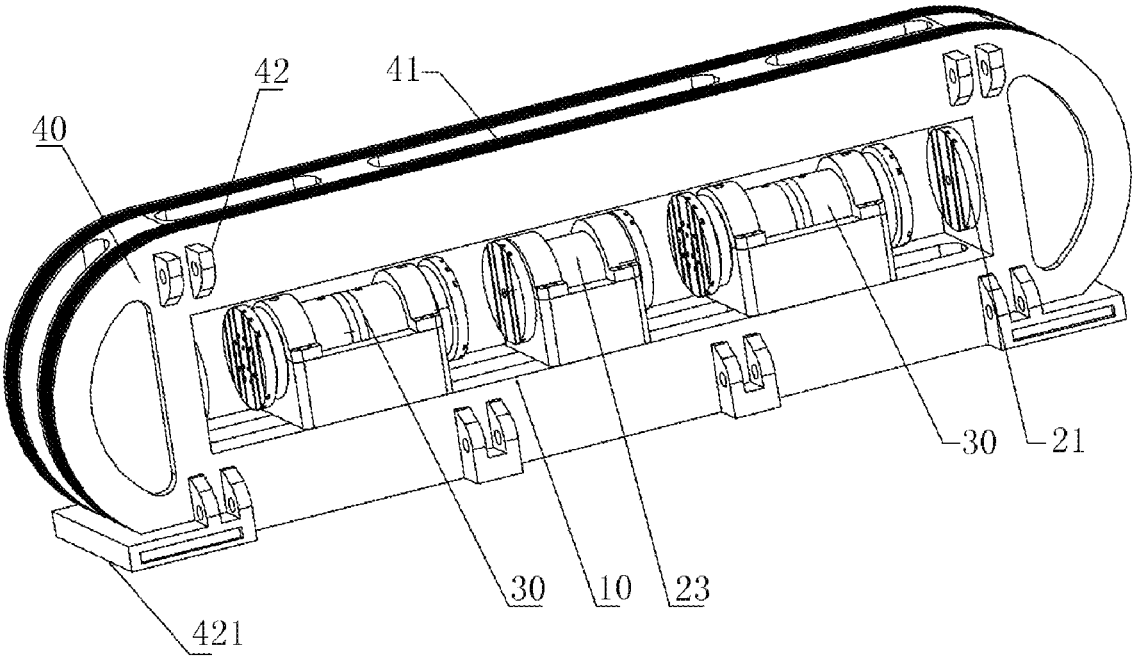
FIG. 14 is a perspective view of a horizontal type hydraulic machine in another embodiment of the present disclosure.

Furthermore, referring to FIGS. 13 and 14, the hydraulic machine 100 further includes a frame structure 40. The support assembly 10 can be fixed to the frame structure 40, the frame structure 40 has two opposite ends and two sides, and the two ends of the frame structure 40 are sandwiched between the two sides of the frame structure 40. A steel wire element 41 is wound on the outer wall of the frame structure 40. The frame structure 40 can be provided with a connecting element 42. The connecting element 42 can be connected with a seat body 421. The seat body 421 can be connected to the connecting element 42 by bolts or the like.

Especially, the position of the seat body 421 determines that the hydraulic machine 100 is as a vertical hydraulic machine or a horizontal hydraulic machine. In this embodiment, if the seat body 421 is disposed on two sides of the frame structure 41, the hydraulic machine 100 is a horizontal hydraulic machine; if the seat body 421 is disposed at two ends of the frame structure 41, the hydraulic machine 100 is a vertical hydraulic machine.

The working process of the hydraulic machine 100 can be explained as following:

Firstly, locating a work piece needing to be pressed between the main cylinder device 30 and the single-sided support worktable assembly 21, that is, between the movable worktable 22 and the fixed worktable 212, and then starting the main cylinder device 30 to drive the movable worktable 22 to gradually approach the fixed worktable 212 and press the work piece.

Herein, it can be seen that in the present disclosure two or two sets of piston rods 32 are arranged opposite to each other and move along the same straight line. During the operation of the pressing, the two or two sets of the piston rods move along opposite directions, which can effectively maintain the balance of the pressure of the piston rods 32, and the reaction force of the piston rods 32 can also be canceled. In addition, a plurality of work pieces can be simultaneously pressed by the main cylinder device 30 and the two single-sided support worktable assembly 21, a coaxial isobaric state of the cylinder sleeve 31 along the axis can be formed, so that the plurality of work in the plurality of pressing mechanisms will be pressed under the same pressure. The plurality of work pieces can keep in a consistency after being pressed, and multiple hydraulic machines can be integrated, which greatly improves production efficiency.

Figure 15:
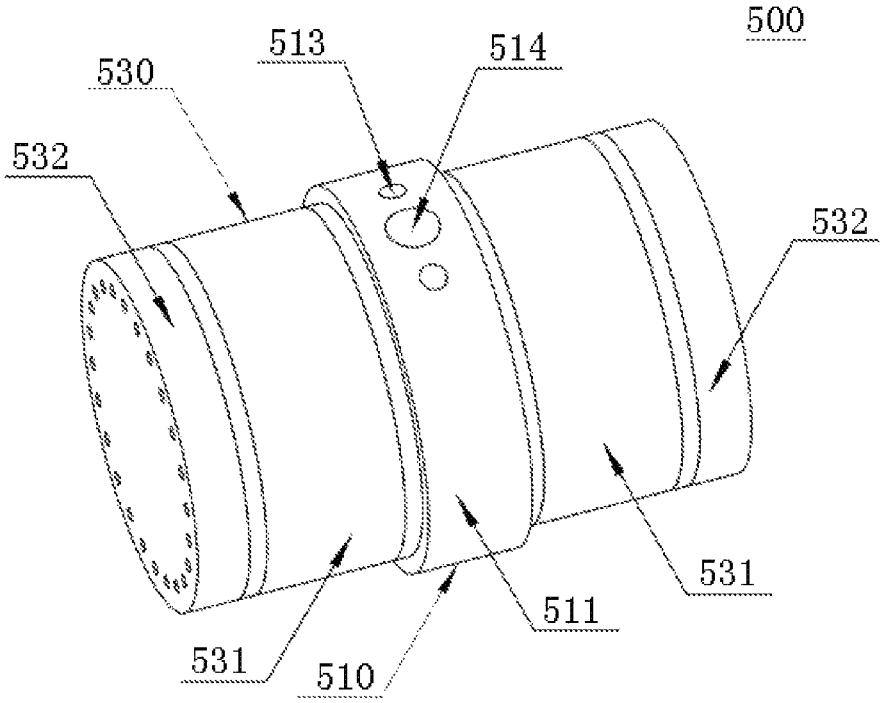
FIG. 15 is a perspective view of a single plunger double acting cylinder in another embodiment of the present disclosure.
Figure 16:
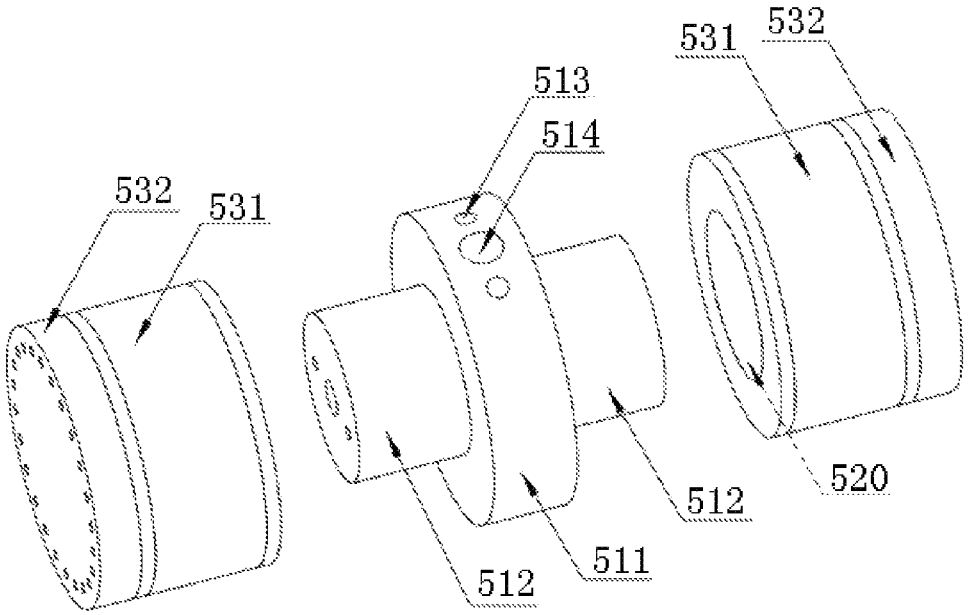
FIG. 16 is an exploded perspective view of a single plunger double acting cylinder in another embodiment of the present disclosure.
Figure 17:
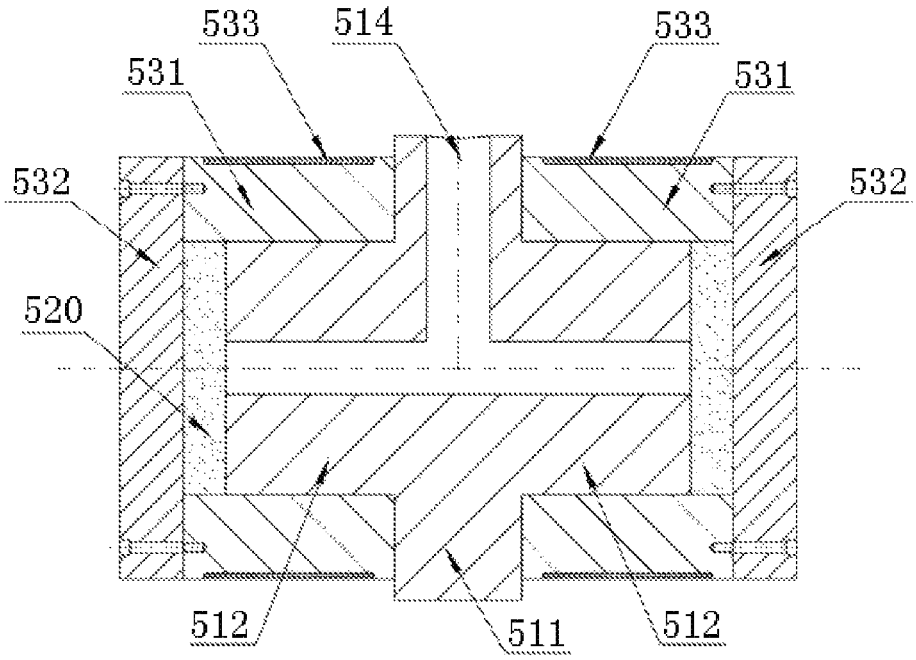
FIG. 17 is a cross-sectional view of a single plunger double acting cylinder in another embodiment of the present disclosure.

Referring to FIG. 15 to FIG. 17, the present disclosure further provides a single plunger double acting cylinder 500.

The single plunger double acting cylinder 500 includes a plunger 510 and two cylinders 530. The plunger 510 includes a plunger seat 511 and two coaxial plunger rods 512. The two plunger rods 512 are respectively disposed on two sides of the plunger seat 511. The cylinder 530 is provided with a blind hole (not shown) coupled to the plunger rods 512. One end of the plunger rod 512 extends into the blind hole and an oil chamber 520 is defined between the inner wall of the blind hole and the one end of the plunger rod 512. The plunger rod 512 is provided with a through hole communicated with the oil chamber 520 and configured for oil injection and/or oil draining. When the two cylinders move axially in the opposite direction along the plunger rod 512 when injecting oil in or draining oil from the oil chamber 520.

In detail, the single plunger double acting cylinder 500 can be composed of a plunger 510 and two cylinders 530. The plunger 510 can be fixedly disposed. The plunger 510 includes a plunger seat 511 and two plunger rods 512. Preferably, the plunger seat 511 and the two plunger rods 512 can form an integrity structure, that is, one end of each of the two plunger rods 512 can be respectively disposed on opposite sides of plunger seat 511, in order to form a structure of the plunger rods 512 at both ends and the plunger seat 511 in the middle. The plunger seat 511 is disposed coaxially with the plunger rods 512. A blind hole is defined in the cylinder 530. The plunger rod 512 can be matched with the size of the blind hole, and the other ends of the two plunger rods 512 are respectively slidably engaged with the two cylinders 530. It should be noted that the blind hole has a depth greater than the length of the plunger rods 512. When the plunger rod 512 is fully inserted into the blind hole, a part of the blind hole is still in a cavity state, which is defined as the oil chamber 520. The plunger rod 512 is provided with a through hole configured for connecting the outside and the oil chamber 520. When the oil is injected into the oil chamber 520 through the through hole, the oil chamber 520 is pressurized to increase the space. Since the plunger 510 is fixed, the oil in the oil chamber 520 will push the cylinder 530 to move, resulting in the two cylinders 530 respectively move away from the plunger rod 512. The cylinder 530 can be connected to the pressing mechanism. The two cylinders 530 can supply the same pressure to the pressing mechanism due to the through hole. When the oil is drained from the oil chamber 520 through the through hole, that is, the oil in the oil chamber 520 is gradually reduced, the two cylinders 530 will gradually approach the plunger seat 511, the cylinder 530 can drive the pressing mechanism to reset. By injecting or draining the oil, the two cylinders 530 can move in opposite directions to each other, thereby realizing pushing and resetting of the pressing mechanism and one plunger enable to provide two compression forces with equal pressure.

The shape of the plunger 510 in the present disclosure can be set according to requirements, and the cross section of the plunger rod 512 can be in a circular shape, a polygonal shape, or a regular polygon shape, and only needs to realize tight sliding between the plunger rod 512 and the blind hole. The shape of the plunger seat 511 can be various and not limited to the perspective view of the present disclosure. As a preferred embodiment, both the plunger seat 511 and the plunger rod 512 can be cylindrical, and the radius of the cross-section of the plunger seat 511 is larger than that of the cross-section of the plunger rod 512. Because the plunger rod 512 is matched with the cylinder 530, the plunger seat 511 has a larger cross section, which can satisfy to limit the cylinder 530, and ensures that the cylinder 530 tightly couples to the plunger rod 512. Furthermore, the inner wall of the blind hole of the plunger rod 512 or the cylinder 530 can be provided with a limiting member configured for preventing the plunger rod 512 from falling off, thereby ensuring the moving distance and repeated movement of the plunger rod 512 and the cylinder 530.

Preferably, the through holes can be T-shaped which extends from the radially outer surface of the plunger seat 511 toward a centroid of the plunger seat 511, and then extends axially from the centroid of the plunger seat 511 to the plunger rod 512. The through holes can be in the T-shaped type, and the two plunger rods 512 are disposed coaxially with the plunger seat 511, that is, a cross-sectional center of the plunger rod 512 is located in the same axis as a cross-sectional center of the plunger seat 511, and therefore, the intersection of the through holes can be preferably located on the centroid of the plunger seat 511. Furthermore, the through holes include a booster hole 513 and a rapid flushing hole 514. The diameter of the rapid flushing hole 514 is larger than the diameter of the booster hole 513. The booster hole 513 can provide sufficient pressure for the oil chamber 520 to ensure the stability of the oil injecting. The rapid flushing hole 514 can be used to quickly inject the oil and drain the oil. In an initial movement of the cylinder, due to a small pressure, the volume of the oil chamber 520 can be rapidly changed through the rapid flushing hole 514. When the cylinder 530 gradually needs to apply a stable constant pressure, the diameter of the booster hole 513 is small, and the oil can be gradually injected into the oil chamber 520 to smoothly increase the pressure value of the oil chamber 520, thereby ensuring the cylinder 530 maintaining a sufficient and stable pressure.

The cylinder 530 herein in the present disclosure is a pressing portion for achieving press-fitting. For easy installation and connection with other pressing mechanisms, the cylinder 530 can include a casing 531 and a cylinder cover 532. The casing 531 can be tubular. A part of the casing 531 is coupled to the plunger rod 512. One end of the casing 531 is engaged with the plunger rod 512, and the other end of the casing 531 is tightly connected with the cylinder cover 532. The casing 531 is provided with a connection hole in the axis, which is configured for coupling to the plunger rod 512. The connection hole can substantially play a role as the blind hole of the cylinder 530, except for both ends of the casing 531 are open, and the other end is closed by the cylinder cover 532. The cylinder cover 532 can be connected with the pressing mechanism according to actual needs to realize the connection of the pressing force.

Since the casing 531 plays a role of a structure of repeated movement and repeated resetting, the outer wall of the casing 531 is provided with a pre-stressed tensioning device 533, or the outer wall of the casing 531 is provided with a tensioning device with an interference fit, in order to ensure the stability of the casing 531. The casing 531 can be fastened by the pre-stressed tensioning device 533. Preferably, the pre-stressed tensioning device is a pre-stress wound steel wire. The pre-stressed wound steel wire can ensure the bearing pressure of the casing 531, provide the strength and fatigue resistance of the casing 531, effectively ensure the pressure of the oil chamber 520, and improve the service life of the casing 531.

The cylinder cover 532 is connected to the casing 531. The cylinder cover 532 may be flange connected to the casing 531. The cylinder cover 532 is provided with an opening configured for mounting bolts and the casing 531 is provided with a screw hole corresponding to the position of the opening. The flange connection can ensure the stability of the connection. In order to improve the sealing effect, a sealing ring (not shown) can be provided at a joint of the cylinder cover 532 and the casing 531, and outer wall of the end of the plunger rod 512 slidably coupling to the casing 531 is provided with a mechanical sealing device (not shown). Through the sealing ring and the mechanical sealing device, it is ensured that the oil chamber 520 does not leak oil when injecting and draining oil, thereby ensuring the pressure stability.

The present disclosure realizes a two-power structure and a plunger 510 by providing a fixed plunger 510 and a movable cylinder 530. The plunger 510 is fixed and the cylinder 530 is slidably coupled to the plunger 510, thereby ensuring power output of the hydraulic mechanism and providing two power mechanisms with the same pressure to ensure equal pressure on both sides. It can effectively improve the working efficiency of the hydraulic mechanism, ensure the pressure balance, and also effectively save equipment manufacturing costs and save resources. The present disclosure has reasonable structure, simple structure and strong practicability, and is beneficial to promotion and application.

Embodiment 3

This embodiment provides a single plunger double acting cylinder 500, which includes a plunger 510 and two cylinders 530. The two cylinders 530 are respectively defined as a first cylinder and a second cylinder, and the plunger 510 is fixed. The plunger 510 is an integrity structure composed of a plunger seat 511 and two plunger rods 512. The two plunger rods 512 are defined as a first plunger rod and a second plunger rod. The plunger seat 511 and the plunger rods 512 can be in column shape. The two plunger rods 512 are coaxially disposed on both sides of the plunger seat 511. The cross-sectional area of the plunger seat 511 is twice of the cross-sectional area of the plunger rod 512, that is, the ratio of the cross-sectional radius of the plunger seat 511 to the cross-sectional radius of the plunger rod 512 is about 1.4:1.

The two cylinders 530 have the same structure, and each includes a casing 531 in a tube shape and a cylinder cover 532. Inner wall of the casing 531 is slidably coupled to the axial outer wall of the plunger rods 512. Length of the inner wall of the casing 531 is longer than effective length of the plunger rods 512. One end of the casing 531 is coupled to the plunger rod 512, the other end of the casing 531 is tightly connected with the cylinder cover 532, the plunger rod 512 extends into tube hole of the casing 531, and one end of the plunger rod 512 and the cylinder cover 532 is a cavity defined as an oil chamber 520.

Herein, the plunger rod 511 is provided with a plurality of T-shaped through holes, which from the radially outer surface of the plunger seat 511 toward a centroid of the plunger seat 511, and then extends axially from the centroid of the plunger seat 511 to the plunger rod 512. The plurality of through holes include two booster holes 513 and a rapid flushing hole 514. The rapid flushing hole 514 is located on the centroid of the plunger seat 511. The two booster holes 513 are respectively located on two sides of the rapid flushing hole 514. The plurality of through holes are configured for make the oil chamber 520 communicate with the outside. The two plunger rods 512 are respectively coupled to the two casings 531 to form two oil chambers 520. Because of the plurality of through holes, pressure in the two oil chambers 520 are equal to ensure impulse forces of the two oil chambers 520 are the same.

Outer wall of the casing 531 is provided with a pre-stress wound steel wire to ensure compression resistance of the casing 531. The cylinder cover 532 is provided with an opening configured for mounting bolts and the casing 531 is provided with a screw hole corresponding to the position of the opening. The cylinder cover 532 may be flange connected to the casing 531. A sealing ring can be provided at a joint of the cylinder cover 532 and the casing 531, and outer wall of the end of the plunger rod 512 slidably coupling to the casing 531 is provided with a mechanical sealing device.

The working principle of the single plunger double acting cylinder 500 is as follows:

When oil is injected to the oil chamber 520 by the rapid flushing hole 514, the space of the oil chamber 520 is gradually increased. Since the plunger 510 is fixed, the two oil chambers 520 are communicated with each other under the same pressure, and the two oil chambers 520 will be gradually pushed to move in reverse directions. The two oil chambers 520 can provide two same pressures. When the pressure is increased to a certain value, the oil pressure is gradually increased through the booster hole 513 to achieve steady progress. When the oil is drained through the rapid flushing hole 514, the space of the oil chamber 520 is reduced, and the two cylinders are returned and close to each other.

Figure 18:
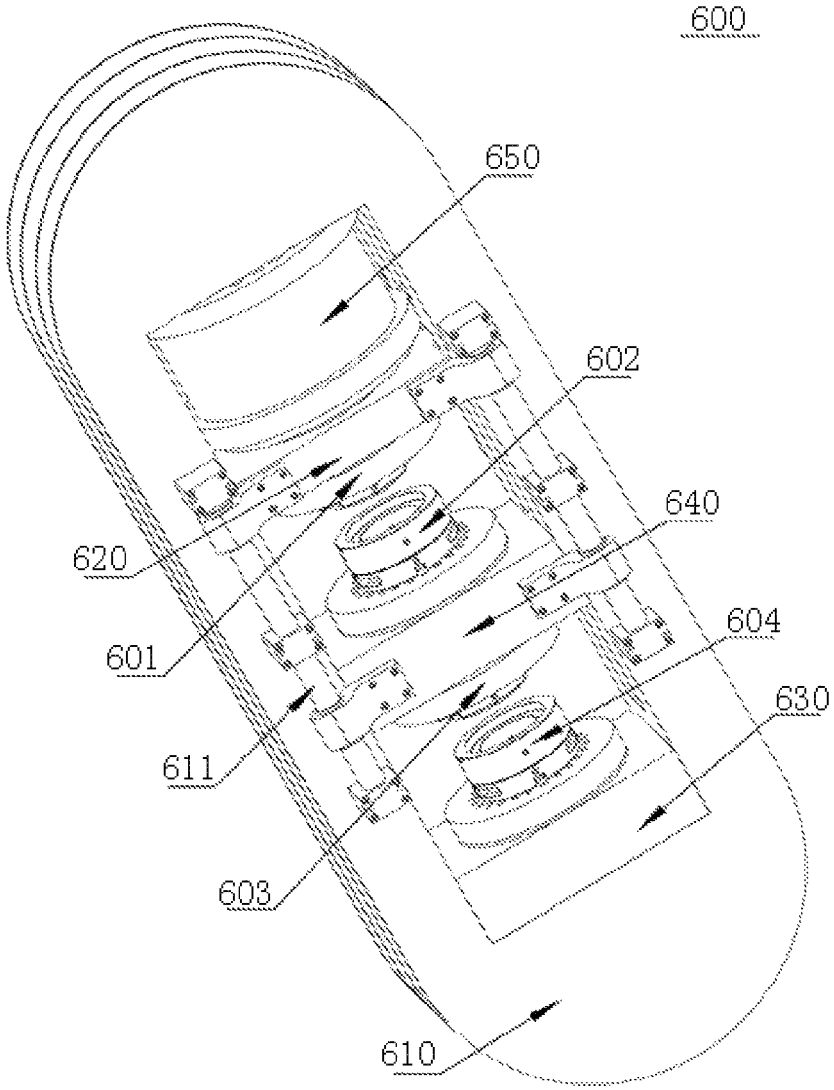
FIG. 18 is a perspective view of a series press machine in another embodiment of the present disclosure.
Figure 19:
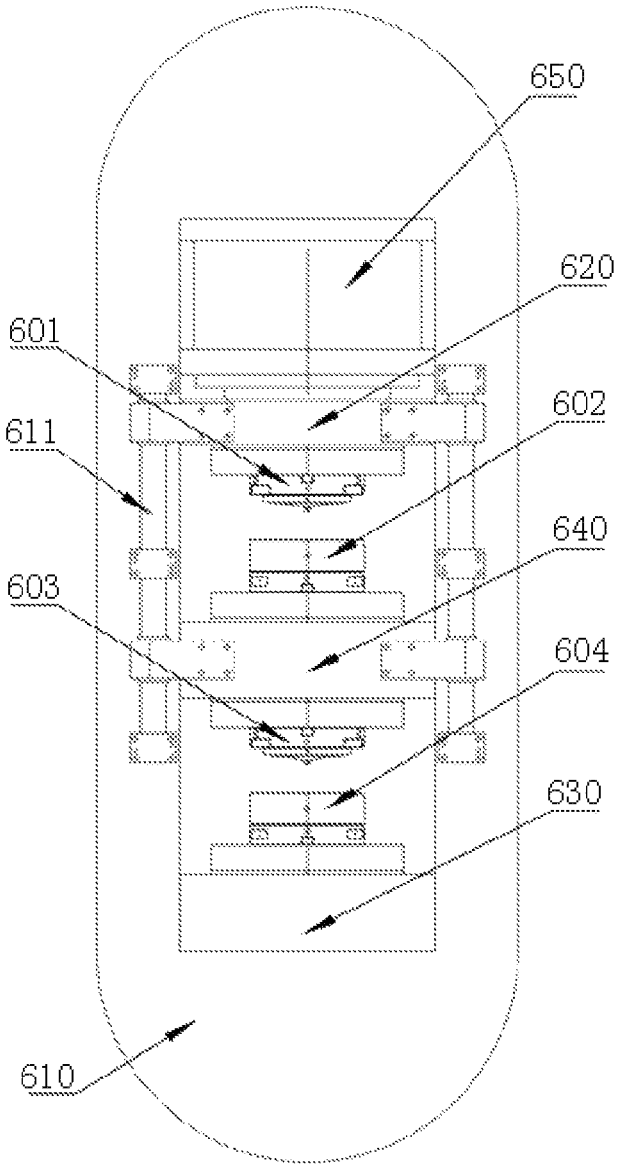
FIG. 19 is a front view of a series press machine in another embodiment of the present disclosure.
Figure 20:
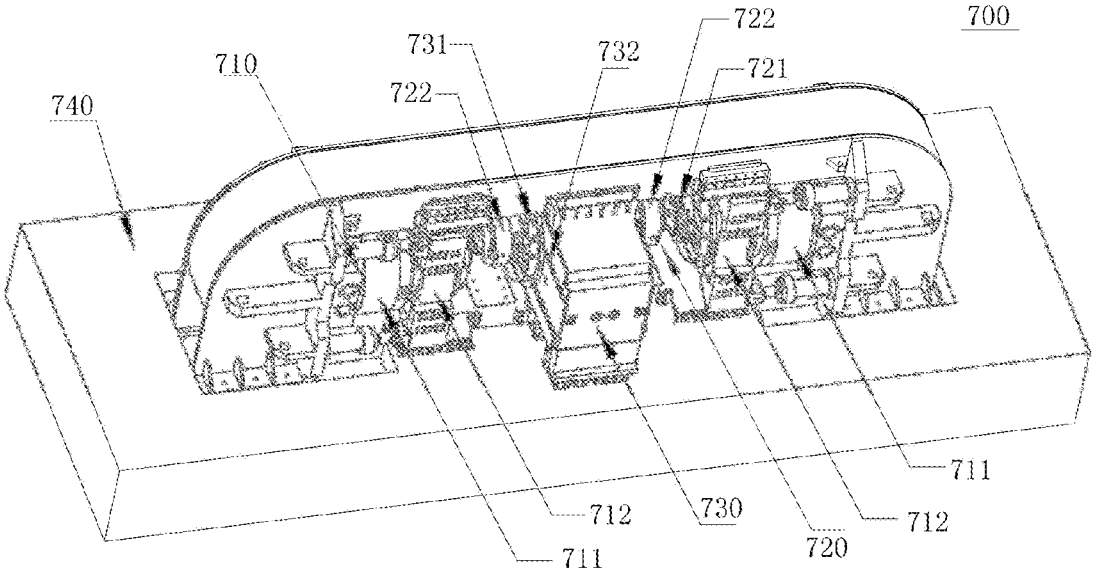
FIG. 20 is a perspective view of a two-head double-cylinder double-station intermediate slider hydraulic machine in another embodiment of the present disclosure.
Figure 21:
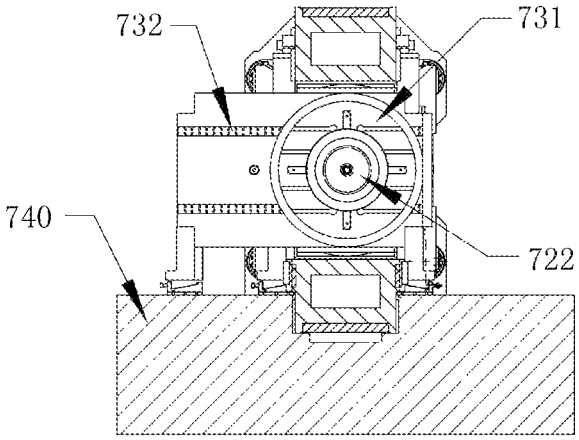
FIG. 21 is a cross-sectional view of a two-head double-cylinder double-station intermediate slider hydraulic machine in another embodiment of the present disclosure.
Figure 22:
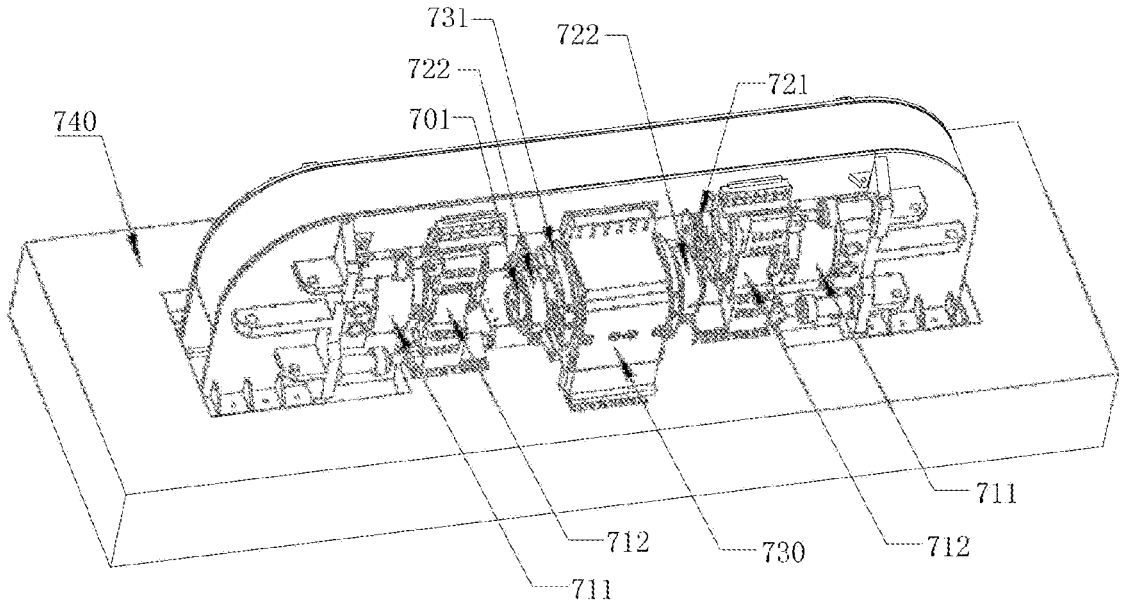
FIG. 22 is a perspective view of a fixed die sliding out in another embodiment of the present disclosure.
Figure 23:
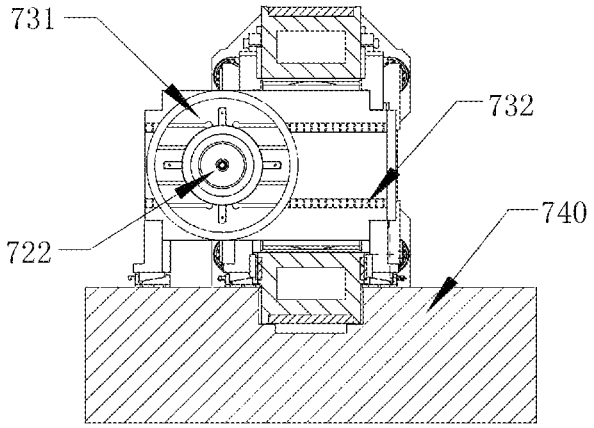
FIG. 23 is a cross-sectional view of a fixed die sliding out in another embodiment of the present disclosure.

Referring to FIGS. 18 and 19, the present disclosure also provides a series press machine 600. The series press machine 600 includes a power device (not shown) mounted on the main frame 610 to provide a power source, a mobile worktable 620 linked to the power device, a fixed table 630 fixed to the main frame 610, and at least one intermediate connecting worktable 640 disposed between the mobile worktable 620 and the fixed table 630 and slidably and/or rollingly connected with the main frame 610. The mobile worktable 620 can gradually move toward the fixed table 630 by driving of the power device, causing the at least one intermediate connecting worktable 640 to slide and/or roll and forming at least two series press mechanisms by the mobile worktable 620, the at least one intermediate connecting worktable 640 and the fixed table 630.

In detail, the main frame 610 is a support structure for mounting other components. The power device is mounted on the main frame 610 and configured for outputting the power source for pressing, for example, the power device may be a hydraulic press, a punch press, a hydraulic press or a pneumatic press. The power device is linked to and provides a power for the mobile worktable 620 and the mobile worktable 620 can move. So, if the power device provides a power source, the mobile worktable 620 can move for a distance or output a pressure. The fixed table 630 is mounted on the main frame 610 to provide stable support. The intermediate connecting worktable 640 is disposed between the mobile worktable 620 and the fixed table 630, and the intermediate connecting worktable is slidably and/or rollingly connected to the main frame 610.

The mobile worktable 620, the fixed table 630, and the intermediate connecting worktable 640 are sequentially connected in series. When the power device outputs a power, the mobile worktable 620 moves toward the fixed table 630. Because the intermediate connecting worktable 640 is between the mobile worktable 620 and the fixed table 630, the intermediate connecting worktable 640 is pushed to slide and/or roll, resulting in the intermediate connecting worktable 640 moves toward the fixed table 630. A pressing mechanism can be respectively formed between the mobile worktable 620 and the intermediate connecting worktable 640 and between the intermediate connecting worktable 640 and the fixed table 630, so that there are at least two pressing mechanisms formed. Moreover, due to the mobility of the intermediate connecting worktable 640, the pressures of the two pressing mechanisms are the same.

When there are two intermediate connecting worktables 640, there will be another pressing mechanism formed between the two intermediate connecting worktables 640. Thereby there are three pressing mechanisms with the same pressure. By analogy, when there are N intermediate connecting worktables 640, N+1 pressing mechanisms with the same pressure can be formed to realize a plurality of work pieces produced under one pressing of the power device. The connection between the intermediate connecting worktable 640 and the main frame 610 is directly related to pressing effect of the series pressing mechanism. Preferably, the intermediate connecting worktable 640 is slidably connected with the main frame 610 by a slider, and the main frame 610 is provided a slide rod 611 coupled to the slider. Through the cooperation of the slide rod 611 and the slider, the intermediate connecting worktable 640 is able to slide. The structure is simple and it is more convenient to install, maintain and operate. Furthermore, the slide rod 611 is provided with a limiting block (not shown) for limiting the sliding distance or position of the slider. The moving distance of each intermediate connecting table 640 is controlled, thereby protecting the safety of the device and leaving a certain space for each pressing mechanism to ensure placement and movement of the work piece.

After the work piece is processed, in order to enable the intermediate connecting worktable 640 to reset automatically, a plurality of springs (not shown) can be disposed between the intermediate connecting worktables 640 and between the intermediate connecting worktable 640 and the fixed table 630. The plurality of springs can be mounted on the slide rod 611. The limiting block limits the normal length of the plurality of springs. When the series pressing machine 600 is not working, the distance between each pressing mechanism is equal. When the series pressing machine 600 is pressed, the plurality of spring can be compressed and the work piece pressing process is not affected. After the pressing, the mobile worktable 620 can return to the original position by the power device, and the intermediate connecting worktable 640 can return to the original position by the plurality of springs.

The work piece cannot be pressed without a mold. The hydraulic machine further includes a at least two sets of work molds, which are respectively disposed between the mobile worktable 620 and the intermediate connecting worktable 640 and between the intermediate connecting worktable 640 and the fixed table 630. Each set of work mold is accordingly mounted on each press mechanism. When there are a plurality of intermediate connecting worktables 640, a plurality of sets of work molds are also installed between two of the plurality of intermediate connecting worktables 640. Preferably, each set of work molds includes a male mold and a female mold, the male mold can be installed at a pressing end of the pressing mechanism, and the female mold can be installed at a pressed end of the pressing mechanism. In the pressing mechanism including the mobile worktable 620 and the intermediate connecting worktable 640, the male mold can be mounted on the mobile worktable 620, and the female mold can be mounted on the intermediate connecting worktable 640. In the pressing mechanism including two intermediate connecting worktables 640, the male mold can be mounted on the intermediate connecting worktable 640 that is moving first or adjacent to the mobile worktable 620, the female mold can be mounted on the other intermediate connecting worktable 640.

The main frame 610 provides support for the entire machine. The main frame 610 is an enclosed wrap structure and provided with a mounting position of the mounting components. The enclosed wrap structure of the main frame 610 effectively improves the stability of the machine.

In the series pressing of the present disclosure, in order to better ensure the pressure equalization, the centroids of the mobile worktable 620, the intermediate connecting worktable 640, and the fixed table 630 are located on the same axis. The power device can be a cylinder. The piston telescopic shaft of the cylinder coincides with the axis of the mobile worktable 620, the intermediate connecting worktable 640, and the fixed table 630. That is, the mobile worktable 620, the intermediate connecting worktable 640, and the fixed table 630 are pressed on the axis of power output of the power device, and the pressure receiving centers of the series pressure receiving devices are coaxial, ensuring pressing positions of each pressing mechanism are coaxial, in order to equalize the pressure of each work piece.

In the present disclosure, the mobile worktable 620, the intermediate connecting worktable 640, and the fixed table 630 are connected in series by the series pressing mechanism and mobility of the intermediate connecting worktable 640, to improve product efficiency and optimization of production structure, saving production costs and resources. And due to the mobility of the intermediate connecting worktable 640, the re ization of each pressing mechanism is equally pressed, thereby ensuring production quality.

Embodiment 4

Referring to FIG. 18 and FIG. 19, a series press machine 600 in this embodiment includes a main frame 610, a mobile worktable 620, a fixed table 630, an intermediate connecting table 640, and a hydraulic cylinder 650. The hydraulic cylinder 650 and the fixed table 630 are both fixed on the main frame 610. The hydraulic cylinder 650 is a power output device and linked with the mobile worktable 620. The intermediate connecting worktable 640 is provided with a slider, the main frame 610 is provided with a slide rod 611, and the slider cooperates with the slide rod 611 to enable the intermediate connecting worktable 640 to slide. The pressing or pressed centers of the mobile table 620, the intermediate connecting worktable 640, and the fixed table 630 are coaxial.

The hydraulic cylinder 650 is disposed on the top of the main frame 610. The mobile table 620, the intermediate connecting worktable 640, and the fixed table 630 are located on the main frame in order. A top surface of the moving table 620 is connected with the hydraulic cylinder 650. A bottom surface of the fixed table 630 is fixedly connected to the main frame 610. A bottom surface of the mobile worktable 620 is connected to a first male mold 601. A top surface of the intermediate connecting worktable 640 is connected to the first female mold 602. A bottom surface of the intermediate connecting worktable 640 is connected to a second male mold 603. A top surface of the fixed table 630 is connected to a second female mold 604.

The sliding rod 611 is provided with a limiting block (not shown) and a spring (not shown). The spring is disposed on a part of the slide rod 611 between the intermediate connecting table 640 and the fixed table 630. The limiting block is configured for limiting the distance between the slider and the spring. In the normal state in which the machine does not work, the spring is extended. Due to the limiting block, the position of the slider is fixed, and the position of the intermediate connecting worktable 640 remains unchanged. In this state, the distance between the first male mold 601 and the first female mold 602 is L, and the distance between the second male mold 603 and the second female mold 604 is D. L and D are nearly equal or equal, which ensures that the gaps between the two pressing mechanisms are the same, in order to accommodate the work piece.

The working principle of the series press machine 600 is as follows:

The two work pieces to be processed are respectively placed on the first mother mold 602 and the second female mold 604. The hydraulic cylinder 650 is activated. The hydraulic cylinder 650 drives the mobile worktable 620 to move downward, so that the first male mold 601 is moved to the first female mold 602 until the first male mold 601 is in contact with the work piece, and the workpiece is pressed, resulting in the intermediate connecting worktable 640 moves synchronously with the mobile worktable 620. When the work piece between the second male mold 603 and the second female mold 604 is pressed, the moving speed of the mobile worktable 620 and the intermediate connecting worktable 640 is slowed down. The hydraulic cylinder 650 continues to be pressurized, the mobile table 620 and the intermediate connecting worktable 640 are slowly moved, and the two work pieces are pressed by the molds to complete the pressing process.

Due to the sliding of the intermediate connecting worktable 640, the pressure of the work piece between the first male mold 601 and the first female mold 602 are equal to that of the work piece of the second male mold 603 and the second female mold 604. The pressure of the two work pieces is the same when pressed. In the present disclosure, it can effectively improve production efficiency and ensure product quality.

Referring to FIG. 20 to FIG. 23, the present disclosure further provides a two-head two-cylinder double-station intermediate slider hydraulic machine 700.

Embodiment 5

The two-head two-cylinder double-station intermediate slider hydraulic machine 700 in this embodiment includes a power assembly 710, a mold assembly 720, a fixed platform 730, and a support base 740. The power assembly 710 and the fixed platform 730 are both mounted on the support base 740. The mold assembly 720 includes an acting die 721 and a fixed die 722. The acting die 721 is mounted on the power assembly 710. The fixed die 722 is mounted on the fixed platform 730. The fixed die 722 can move along a direction perpendicular to a moving direction of the acting die 721.

In detail, the power assembly 710 is configured for providing punching power. The mold assembly 720 is configured for stamping a product model, and the fixed platform 730 is configured for mounting a part of the mold assembly 720. The support base is configured for providing an overall support table. The mold assembly 720 generally includes two parts, in this embodiment; one is the acting die 721 and the other is a fixed die 722. The acting die 721 is connected to the power assembly 710 and can move by the power assembly 710. The fixed die is connected with the fixed platform 730 and can be matched with the acting die 721 to form a stamping die for completing the stamping process. The fixed die 722 is able to move along the direction perpendicular to the moving direction of the acting die 721. In this embodiment, the acting die 721 and the fixed die 722 are horizontally moved, and the moving directions of the two are in a certain horizontal plane. The moving direction of the acting die 721 and the fixed die 722 is not in the same horizontal plane. It should be noted that the fixed die 722 can be moved herein including the fixed die 722 moving solely and moving along with other components. For example, the fixed die 722 is separately moved on the fixed platform 730, or the fixed die 722 is fixed on the fixed platform 730 which is able to move, as long as the fixed die 722 is able to move to ensure the stamped module being taken out and other components of the stamping apparatus not obstructed.

In use, the material to be processed is placed onto the mold. In this embodiment, the material is placed on the fixed die 722. The power assembly 710 is driven. The acting die 721 gradually closes to the fixed die 722 matched with the acting die 721. After the mold is punched, the power assembly 710 moves away from the fixed die 722 and the acting die 721 is separated from the fixed die 722. The fixed die 722 is moved along a lateral direction relative to the acting die 721. After the fixed die 722 moves, the stamped work piece 701 can be conveniently taken out. At this time, it is not needed to move the acting die 721 away and the stamping of the work piece 701 can be completed, as long as a center of the acting die 721 and a center of the fixed die 722 are not in a line. The moving route of the acting die 721 will be increased, power consumption will be reduced and the processing efficiency of the work piece 701 will be improved.

Embodiment 6

The two-head two-cylinder double-station intermediate slider hydraulic machine 700 in this embodiment includes at least two sets of power assemblies 710, a plurality of mold assemblies 720, at least one fixed platform 730, and a support base 740. Both the at least two sets of power assemblies 710 and the at least one fixed platform 730 are mounted on the support base 740. The at least two sets of power assemblies 710 are coaxially or substantially coaxially disposed with the at least one fixed platform 730. Each of the mold assemblies 720 includes an acting die 721 and a fixed die 722. The acting die 721 is mounted on the power assembly 710, and the fixed die 722 is mounted on the fixed platform 730. The acting die 721 is driven by the power assembly 710, gradually close to and matches with the fixed die 722, resulting in forming at least two sets of punching mechanisms.

In detail, the number of the power assemblies 710 is at least two sets, and the number of the fixed platform 730 is at least one. Preferably, the number of the power assemblies 710 is two sets, and the number of the fixed platform 730 is one. Two sets of power assemblies 710 are respectively disposed on two sides of the fixed platform 730, and are disposed coaxially with the fixed platform 730. The fixed platform 730 is mounted on the support base 740. The number of the mold assemblies 720 is two sets, the fixed dies 722 are respectively disposed on both sides of the fixed platform 730, and the acting dies 721 and the fixed dies 722 are coaxial.

The power assembly 710 includes a power cylinder 711 and a piston slider 712. The piston slider 712 is drivingly coupled to the power cylinder 711, and the acting die 721 is mounted at an end of the piston slider 712. The power cylinder 711 is mounted on the support base 740. One end of the piston slider 712 is connected to the power cylinder 711, and the other end of the piston slider 712 is connected to the acting mold 721. When the power output is required, the oil injects to the power cylinder 711, the piston slider 712 gradually moves away from the power cylinder 711 to drive the acting die 721 to move. Preferably, the support base 740 is provided with a rail or a slide for the movement of the piston slider 712. Because of the limit and guiding effect of the rail, the moving direction and stability of the acting die 721 is ensured and the punching quality is improved.

Preferably, the acting die 721 is a convex mold, the fixed die 722 is a concave mold, and the fixed platform 730 is provided with an ejector device configured for taking out the stamped product from the concave mold. In this embodiment, the fixed platform 730 is provided with a sliding rail 732 and a slider 731 slidably matched with the sliding rail 732. The fixed die 722 is mounted on the slider 731. The sliding direction of the slider 731 is perpendicular to the moving direction of the acting die 721. The acting die 721 and the slider 731 are both horizontally moved. The length of the sliding rail 732 at least extends out of the circumferential outer side of the mold assembly 720 to ensure that the work piece 701 in the female mold can be taken out and other parts of the stamping device can be removed without obstacles after the female mold is moved out. In use, the concave mold horizontally moves, the two work pieces to be processed are placed on the concave molds on both sides of the fixed platform 730, and the concave mold moves back. At this time, the two concave molds are coaxial with the two convex molds. The acting die 721 moved after being driven by the power assembly 710. After the acting die 721 and the fixed die 722 are stamped, the power assembly 710 drives the acting die 721 away from the fixed die 722. After the acting die 721 and the fixed die 722 are completely separated, the power assembly 710 stops driving. The slider 731 is removed from the concave mole, and the stamped workpiece 701 is removed from the concave mold. Two work pieces 701 can be obtained by one stamping process. In this embodiment, two work pieces 701 can be completed in one stamping process, and the moving route of the acting die 721 is reduced, the power consumption is reduced, and the production efficiency is effectively improved.

Embodiment 7

The difference between this embodiment and the embodiment 2 is that the fixed platform 730 is slidably disposed on the support base 740. A sliding direction of the fixed platform 730 is perpendicular to the moving direction of the acting die 721, and both the acting die 721 and the fixed platforms 730 horizontally move, and the fixed platform 730 is at least capable of sliding out of the circumferential outer edge of the mold assembly 720. By fixing the fixed die 722 on the fixed platform 730 and moving the fixed platform 730, the purpose of the present disclosure can also be achieved. Preferably, the fixed platform 730 is provided with a sliding locking device (not shown) to avoid the fixed die 722 small amplitude movement or shaking which can occur during stamping and stamping errors due to mold misalignment.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A hydraulic machine, comprising:

a support assembly;

a main cylinder device connected with the support assembly, wherein the main cylinder device comprises at least two main cylinder assemblies and at least two piston rods respectively connected with the at least two main cylinder assemblies, a hydraulic chamber is formed between each of the at least two piston rods and each of the at least two main cylinder assemblies, the at least two piston rods are arranged opposite to each other and move along a same straight line and in opposite directions; and a support worktable device disposed on the support assembly and spaced with the main cylinder device, wherein at least two pressing mechanisms are formed between the support worktable device and the at least two main cylinder assemblies or between the support worktable device and the at least two piston rods, and the at least two pressing mechanisms are configured for pressing work pieces simultaneously.

2. The hydraulic machine of claim 1, wherein at least two actuating units are formed by the at least two main cylinder assemblies and the at least two piston rods, the support worktable device is disposed between the at least two actuating units, and the at least two pressing mechanisms are respectively formed between the support worktable device and each of the at least two actuating units.

3. The hydraulic machine of claim 2, wherein the support worktable device comprises two fixed worktables which are coaxially fixed and opposite to each other, and the at least two pressing mechanisms are respectively formed between each of the two fixed worktables and each of the at least two actuating units.

4. The hydraulic machine of claim 3, wherein the support worktable device is slidably connected with the support assembly, and the support worktable device slides along a direction along a same axis as a moving direction of the at least two piston rods.

5. The hydraulic machine of claim 3, wherein a plurality of worktables is disposed between the fixed worktable and the at least two actuating units, and at least one of the plurality of worktables is slidably disposed on the support assembly.

6. The hydraulic machine of claim 2, wherein the support worktable device comprises two fixed worktables which are coaxially fixed and opposite to each other, and the at least two actuating units are disposed between the two fixed worktables.

7. The hydraulic machine of claim 3, wherein the support worktable device further comprises a movable worktable disposed on one of the at least two piston rods.

8. The hydraulic machine of claim 7, wherein the two fixed worktables and/or the movable worktable are respectively provided with a center hole ejection device configured for demolding.

9. The hydraulic machine of claim 7, wherein the two fixed worktables and/or the movable worktable are respectively provided with a T-type slot configured for mounting a mold.

10. The hydraulic machine of claim 6, wherein the at least two main cylinder assemblies are fixed and interconnected to form an integral cylinder unit, and the at least two piston rods respectively extend out from ends of the cylinder unit and are able to move relative to the cylinder unit.

11. The hydraulic machine of claim 1, wherein the at least two main cylinder assemblies are disposed in series.

12. The hydraulic machine of claim 2, wherein the main cylinder comprises a cylinder sleeve and a first cover, the first cover is disposed on an end of the cylinder sleeve, the first cover comprise a second through hole, one end of one of the at least two piston rods is arranged inside the cylinder sleeve, and the other end of the one of the at least two piston rods penetrates through the second through hole of the first cover.

13. The hydraulic machine of claim 2, wherein the support assembly is a closed ring-like structure.

14. The hydraulic machine of claim 2, wherein the support assembly has an elliptical shape.

15. The hydraulic machine of claim 1, wherein the hydraulic machine is selected from a vertical type hydraulic machine and a horizontal type hydraulic machine.

* * * * *